US005443153A

United States Patent [19]

Sutherland

[11] Patent Number: 5,443,153

[45] Date of Patent: Aug. 22, 1995

[54] CLIP-TYPE ARTICLE CARRIER

[75] Inventor: Robert L. Sutherland, Kennesaw, Ga.

[73] Assignee: Riverwood International Corporation, Atlanta, Ga.

[21] Appl. No.: 194,764

[22] Filed: Feb. 10, 1994

[51] Int. Cl.[6] ..... B65D 71/00

[52] U.S. Cl. ..... 206/152; 206/156

[58] Field of Search ..... 206/145–149, 206/151–160, 432; 294/87.2

[56] References Cited

U.S. PATENT DOCUMENTS

| | | | |
|---|---|---|---|
| 3,118,537 | 1/1964 | Copping | 206/153 |
| 3,311,402 | 3/1967 | Spandock | 206/153 |
| 3,503,498 | 3/1970 | Lawrence | 206/152 |
| 3,653,503 | 4/1972 | Arneson | 294/87.2 |
| 3,701,416 | 10/1972 | Lawrence | 294/87.2 |
| 4,336,898 | 6/1982 | Joyce | 294/87.2 |
| 5,201,412 | 4/1993 | Schuster et al. | 206/153 |
| 5,230,425 | 7/1993 | Edqvist et al. | 206/153 |
| 5,310,051 | 5/1994 | Sutherland | 206/153 |
| 5,318,178 | 6/1994 | Davies et al. | 206/152 |

FOREIGN PATENT DOCUMENTS

| | | | |
|---|---|---|---|
| 0260782 | 3/1968 | Australia | 206/151 |

*Primary Examiner*—Jimmy G. Foster

[57] ABSTRACT

A clip-type carrier especially suited for carrying beverage cans or other flanged articles. The carrier is comprised of a panel having slots in folded, wedge-shaped inner support sections and in downwardly folded outer support sections for receiving the can chimes. Reinforcing flaps connected to the outer support sections are folded against the underside of the outer support sections so that the unconnected edges of the flaps contact adjacent articles. A reinforcing strip may be employed to overlie the inner support sections of the carrier.

3 Claims, 2 Drawing Sheets

CLIP-TYPE ARTICLE CARRIER

FIELD OF THE INVENTION

This invention relates to article carriers. More particularly, it relates to clip-type carriers that support articles from the underside of flanges or other lateral projections.

BACKGROUND OF THE INVENTION

Carriers that grip the upper portions of articles so as to suspend them when lifted and carried are known, particularly in connection with the packaging of beverage cans. One type of paperboard carrier employs arcuate slots in a bottom panel for receiving opposite portions of the can chimes, with the adjacent bottom panel edges resulting from the slot formation engaging the underside of the can chime portions. This is typically employed in packages comprised of two adjacent rows of cans, so that the elongated area of the bottom panel between the interior slots folds into wedge-shaped reinforcing ribs extending between the sloped upper portions of the cans. Short side panels connect the bottom panel to top panel flaps, which are glued to the bottom panel, and aligned finger openings in the top panel and in the reinforcing wedge enable the package to be lifted and carried. Although such a carrier has been employed commercially, there is a need in certain product markets for a more economical carrier. The problem in economizing the carrier, which involves reducing the amount of paperboard required by the design, is to accomplish it without impairing the ability of the carrier to withstand the severe stresses to which it is subjected during use.

It is therefore an object of the invention to provide a carrier which retains the benefits of known paperboard clip-type carriers, but in addition provides greater economy of manufacture.

BRIEF SUMMARY OF THE INVENTION

The clip-type carrier of the invention is comprised of a support panel which, like the bottom panel of the carrier described above, includes two spaced parallel inner fold lines extending longitudinally of the panel and two outer fold lines parallel to and outwardly spaced from the inner fold lines. The support panel includes downwardly extending outer support sections connected to the panel along the outer fold lines and downwardly extending inner support sections connected along the inner fold lines, the inner support sections converging toward each other and being connected to each other along a central fold line to form wedge-shaped reinforcing ribs. Each inner and outer fold line is interrupted by spaced slits which form slots in the support sections for receiving portions of the projecting lips of the packaged articles to thereby support the articles. In addition, a reinforcement flap connected to each outer support section is folded under the outer support section so that edge portions of the flap are in contact with adjacent articles.

Both the inner and outer support sections preferably include score lines opposite the articles for distributing stresses to the central fold line and the reinforcing flap fold line, respectively. The reinforcing flaps may also include means for distributing stresses to the reinforcing flap fold line. Additional strength may be added to the carrier by a reinforcing strip attached to the support panel which spans the inner fold lines and which contains finger holes aligned with finger holes in the inner support sections.

The features of the invention which enable it to provide the desired results are brought out in more detail in the description of the preferred embodiment, wherein the above and other aspects of the invention, as well as other benefits, will readily become apparent.

DETAILED DESCRIPTION OF THE PREFERRED EMBODIMENTS

Figure 1:
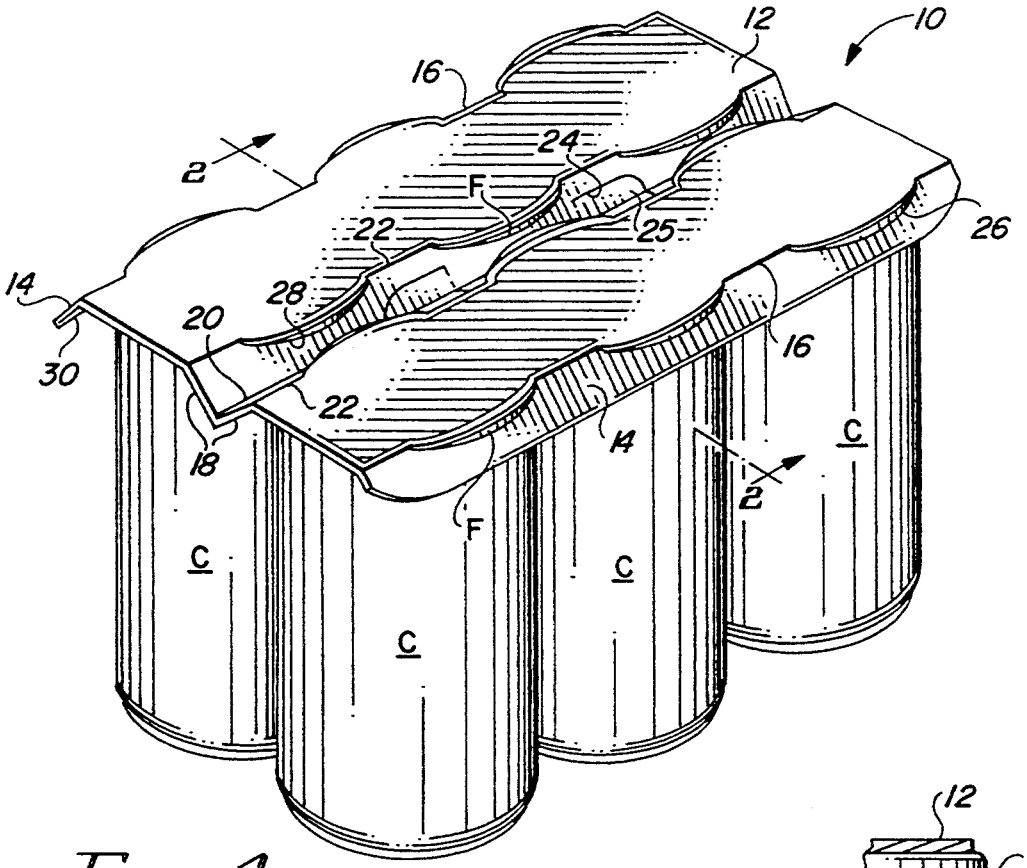
FIG. 1 is a pictorial view of a package of beverage cans the top portions of which are held by the carrier of the invention.

Referring to FIG. 1, a carrier 10 containing six beverage cans C is comprised of a panel 12 having side edge portions which are folded down about fold lines 16 to form outer ribs 14. The central portion of the panel includes downwardly extending inner ribs 18, which are connected to each other by fold line 20 and to the panel 12 by parallel fold lines 22. Finger openings 24, covered by foldably connected flaps 25, straddle the inner ribs 18 on either side of the central fold line 20. Included in the outer ribs 14 are slots 26 through which portions of the can chimes F protrude. Similarly, the inner ribs 18 include slots 28 through which opposite portions of the can chimes protrude. The chimes are engaged by the edges of the outer and inner ribs that define the slots, thereby supporting the cans, with the portions of the panel between the fold lines 16 and 22 overlying the cans. In addition, each side of the carrier is provided with reinforcing flaps 30, only a corner portion of the left reinforcing flap being visible in FIG. 1. These flaps are best seen in FIG. 2, which shows both the slot edge of the outer rib 14 and the end of the flap 30 engaging the adjacent can chime.

Figure 2:
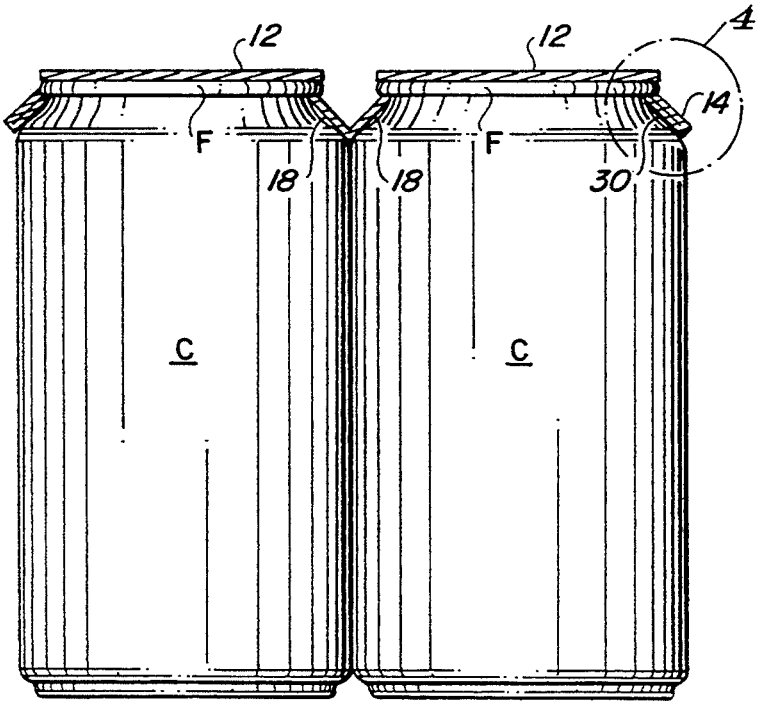
FIG. 2 is a transverse sectional view of the carrier package taken on line 2—2 of FIG. 1.
Figure 3:
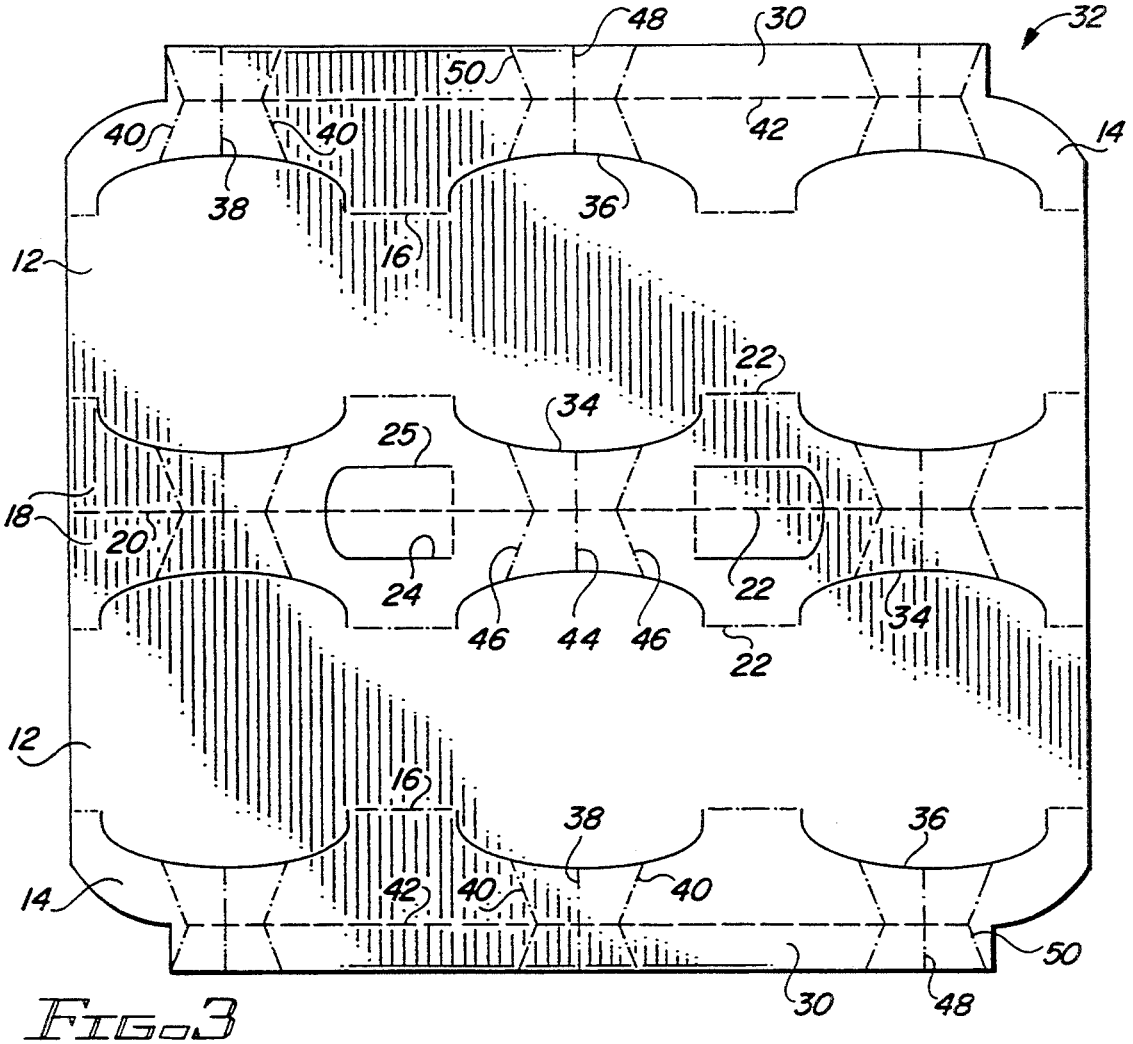
FIG. 3 is a plan view of a blank for forming the support panel of the carrier of FIG. 1.

Referring now to FIG. 3, wherein like reference numerals to those used in FIGS. 1 and 2 denote like structure, the carrier is formed from a generally rectangular blank 32. The fold line 20 is centrally located and extends the full length of the panel. The parallel fold lines 22, which create the rib sections 18, are each interrupted by three curved slits 34, which may be referred to as C-shaped slits, the convex sides of which face the central fold line 20. Each fold line 16 is also interrupted by three C-shaped slits 36 similar to the slits 34 and located so that the concave sides of the slits 36 face the concave side of opposed slits 34 to form pairs of slits. The opening of the slits during application of the blank to the cans forms the slots 26 and 28 as explained below.

Perpendicular score lines 38 and angled score lines 40 extend from the fold lines 42 to the slits 36. This arrangement enables the outer rib sections 14 to more readily conform to the curvature of the cans and to distribute lifting stresses to the fold lines 42. Similarly, the inner rib sections 18 contain perpendicular and angled score lines 44 and 46, respectively, to distribute stresses to the central fold line 20. The reinforcement flaps 30 also include stress distributing perpendicular score lines 48 which extend to the fold line 42. In addition, the reinforcement flaps include angled slits 50 to better enable the flaps to conform to the curvature of the cans. The arrangement of the score lines and slits is such that they are substantially aligned with the score lines 38 and 40 when the reinforcement flaps are folded under in the carrier.

It may be found desirable for the central fold line 20 and the reinforcing flap fold lines 42 to be in the form of skip-cut lines to facilitate folding of the blank along these lines during formation of the carrier. It is preferred, however, that the fold lines 16 and 22 of the panel 12 be in the form of score lines to make the carrier more rigid and resistant to tearing.

To form the carrier of FIG. 1, the blank is positioned on top of a group of six adjacent cans which have been arranged in two rows of three each so that the C-shaped slits are substantially aligned with the rims of the cans. Since the rib sections 18 are still in planar unfolded condition at this point, the two rows of cans will be spaced apart a short distance in order to be properly aligned with the blank, as is well known in the art. Because the distance between the midpoints of opposite C-shaped slits 34 and 36 is substantially equal to the reduced diameter portion of a can just below the can chime, when the blank is pushed down over the cans the can chimes are forced through the slits due to the resiliency of the paperboard until the locking edges formed by the C-shaped slits at the inner rib sections 18 and the outer rib sections 14 snap back into the reduced diameter portion of the cans. During this maneuver, the locking edges formed by the C-shaped slits move downwardly relative to the panel 12, causing the rib sections 18 to fold up about the fold line 20. This moves the panel portions 12 on opposite sides of the inner ribs toward each other and brings the two rows of cans into contact with each other.

Figure 4:
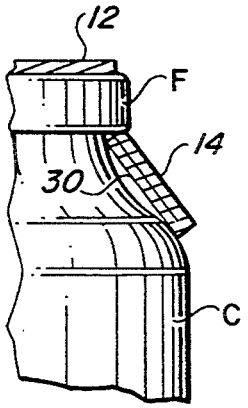
FIG. 4 is an enlarged transverse sectional view of the structure within the circle 4 of FIG. 2.
Figure 5:
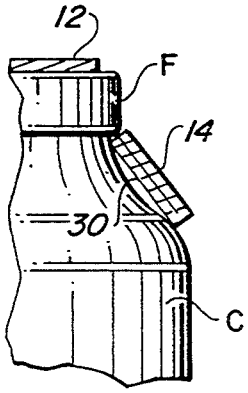
FIG. 5 is an enlarged transverse sectional view similar to that of FIG. 4, but showing the end of the reinforcing flap contacting a different portion of the adjacent can than in FIG. 4.

Prior to relative movement between the blank and the cans the reinforcing flaps 30 are folded under the blank so that both the reinforcing flaps and the outer rib sections 14 function as a unit during the locking steps described above. Thus both the slot edges of the rib sections 14 and the end edge of the reinforcing flaps engage the cans as shown in FIG. 2. This is illustrated more clearly in the enlarged view of this area presented in FIG. 4, wherein both of these edges can be seen to engage the underside of the can chimes F. In some instances, depending on the dimensions of the carrier elements and the cans, the reinforcing flaps may engage the cans just below the chimes as illustrated in FIG. 5. Both are acceptable arrangements since in both cases the weight of the cans is borne at the outer sides of the carrier by two thicknesses of material, each distributing lifting and carrying stresses through their short dimension to the common fold line 42.

Figure 6:
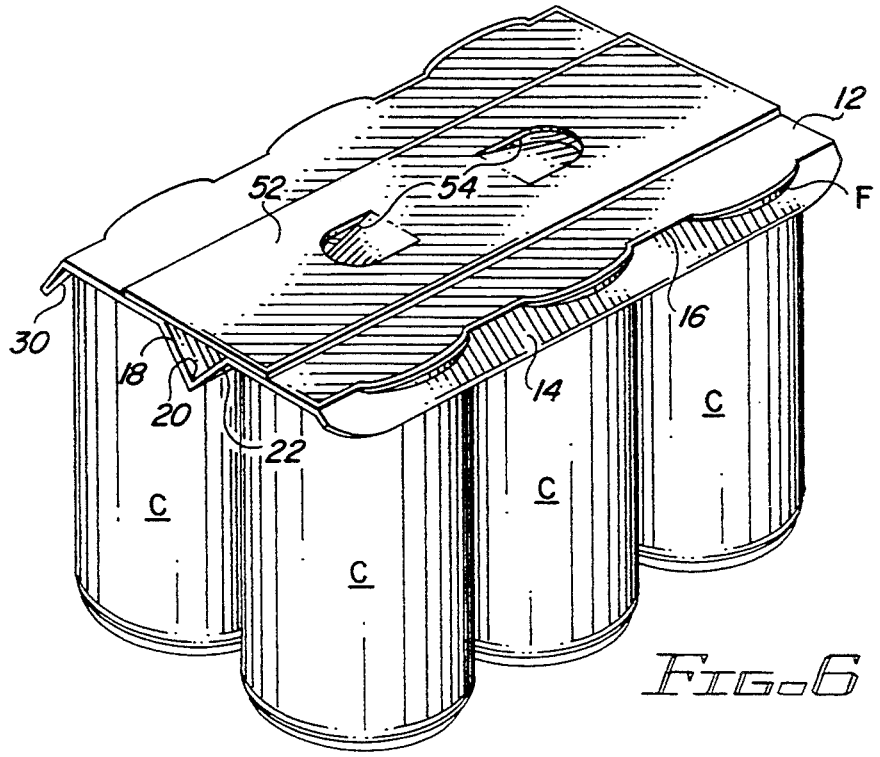
FIG. 6 is a pictorial view of a modified carrier.

It has not been found necessary to make the inner support ribs 18 of double thickness inasmuch as their close proximity to each other and the support offered in the center of the package by the abutting cans themselves makes the single thickness of these support ribs entirely adequate. To ensure against the possibility of the inner support ribs collapsing out of their V-shaped configuration when a user's fingers lift up from beneath the finger holes, however, a reinforcing strip may be applied to the panel 12. As illustrated in FIG. 6, a reinforcing strip 52 is adhered to the top panel 12, as by glue, so as to span the wedge shaped rib sections 18. It will be understood that the reinforcing strip holds the ribs 18 in their folded wedge-shaped configuration to thereby strengthen the carrier. The strip includes finger holes 54 aligned with the finger holes 24 in the inner ribs 18 so that a user's fingers may extend through the aligned holes to lift the carrier. Finger hole cover flaps may also be provided on the reinforcing strip to provide additional lifting support in this area when these flaps are folded down.

Although the carrier is illustrated as being adapted to carry six cans, it will be understood that the invention is not limited by the number of articles supported by the carrier. The articles to be carried must be arranged in adjacent rows, however, in order to create the central ribs 18 in the panel 12.

It will now be clear that the invention reduces the cost of clip-type paperboard carriers without adversely affecting their strength. Although the invention has been described in connection with a carrier designed to hold beverage cans, the principles of the invention are not limited to use with cans, but may be extended to other types of articles having a rim or other projection capable of being gripped by locking or supporting edges of the carrier. Because the invention is not necessarily limited to all the specific details described in connection with the preferred embodiment, except as they may be within the scope of the appended claims, changes to certain features of the preferred embodiment which do not alter the overall basic function and concept of the invention are contemplated.

What is claimed is:

1. A carrier containing adjacent rows of articles, each article having an upper portion which includes an outwardly projecting lip, comprising:

a support panel including two spaced parallel inner fold lines extending longitudinally of the panel and two outer fold lines parallel to and outwardly spaced from the inner fold lines;

the support panel including downwardly extending outer support sections connected thereto along the outer fold lines and downwardly extending inner support sections connected thereto along the inner fold lines, the inner support sections converging toward each other and being connected to each other along a central fold line;

each inner and outer fold line being interrupted by slots through which portions of the projecting lips of the articles protrude;

the slots having lower surfaces engaging the underside of the protruding portions of the article lips to thereby support the articles;

a reinforcement flap connected to each outer support section along a fold line;

each flap being folded under the associated outer support section;

each flap having an unconnected edge, portions of which are in contact with adjacent articles;

the inner and outer support sections including score lines opposite the articles for distributing stresses to the central fold line and to the reinforcing flap fold line, respectively; and the reinforcing flaps including score lines for distributing stresses to the reinforcing flap fold line, said score lines being aligned with the score lines in the adjacent outer support section.

2. A carrier as defined in claim 1, wherein the reinforcing flaps include angled slits aligned with angled score lines in the adjacent outer support section.

3. A blank for forming a clip-type carrier adapted to support adjacent rows of articles having outwardly projecting lips on the upper portions thereof, comprising:

a generally rectangular sheet including two spaced parallel inner fold lines extending longitudinally of the sheet and two outer fold lines parallel to and outwardly spaced from the inner fold lines;

the sheet including outer support sections connected thereto along the outer fold lines and inner support sections connected thereto along the inner fold lines, the inner support sections connected to each other along a central fold line;

each inner and outer fold line being interrupted by spaced slits for forming slots in the support sections for receiving at least portions of the projecting lips of the articles to be carried;

the edges of the outer support sections formed by folding the outer support sections down about their connecting fold lines being adapted to engage the underside of the outwardly projecting lips of articles;

a reinforcement flap connected to each outer support section along a fold line, the flaps being adapted to be folded under the associated outer support section and to contact adjacent articles;

each flap having an unconnected edge, at least portions of which are in contact with adjacent articles in a carrier formed from the blank;

the inner and outer support sections including score lines opposite the spaced slits for distributing stresses to the central fold line and the reinforcement flap fold line, respectively; and the reinforcement flaps including score lines for distributing stresses to the reinforcement flap fold line, said score lines being arranged so as to be aligned with the score lines in the adjacent outer support section of the carrier.

* * * * *